US005593062A

United States Patent [19]

Martin

[11] Patent Number: 5,593,062

[45] Date of Patent: Jan. 14, 1997

[54] SOCIAL SERVING PLATE

[76] Inventor: Melvin E. Martin, 122 E. Little Bay Ave., Yorktown, Va. 23693

[21] Appl. No.: 540,466

[22] Filed: Oct. 10, 1995

[51] Int. Cl.[6] ..... B65D 1/36

[52] U.S. Cl. ..... 220/574.1; 220/575; 220/556; 220/755

[58] Field of Search ..... 220/575, 574, 220/574.1, 556, 23.8, 675, 755; 229/400

[56] References Cited

U.S. PATENT DOCUMENTS

| | | | |
|---|---|---|---|
| D. 221,883 | 9/1971 | Cash | 220/23.8 |
| D. 332,552 | 1/1993 | Lynch . | |
| D. 334,112 | 3/1993 | Carter . | |
| D. 349,212 | 8/1994 | Lynch . | |
| 1,321,145 | 11/1919 | Price | 220/574 |
| 2,032,835 | 3/1936 | Collins | 220/574 |
| 2,561,022 | 7/1951 | Jones | 220/575 |
| 4,232,789 | 11/1980 | Springer | 220/23.8 |
| 5,119,967 | 6/1992 | Ercolani . | |
| 5,141,120 | 8/1992 | Brown et al. | 220/675 |
| 5,285,940 | 2/1994 | Goulter . | |
| 5,301,871 | 4/1994 | Gross et al. . | |
| 5,353,952 | 10/1994 | Donche . | |
| 5,385,260 | 1/1995 | Gatcomb | 229/400 |
| 5,429,231 | 7/1995 | McSpadden | 220/556 |

FOREIGN PATENT DOCUMENTS

| | | |
|---|---|---|
| 508205 | 12/1954 | Canada . |
| 711612 | 6/1965 | Canada . |
| 1408476 | 7/1965 | France . |
| 2426361 | 4/1975 | Germany . |
| 2753762 | 6/1979 | Germany . |
| 255643 | 7/1926 | United Kingdom . |
| 266528 | 3/1927 | United Kingdom . |
| 1204633 | 9/1970 | United Kingdom . |
| 2078493 | 1/1982 | United Kingdom . |

*Primary Examiner*—Stephen J. Castellano
*Attorney, Agent, or Firm*—Richard C. Litman

[57] ABSTRACT

A plate for serving food at social gatherings where the guests may stand and eat at the same time, has a depression in its center, which on the upper surface of the plate can hold a cup, and on the lower surface may serve as a handle by which the plate can be held, so that the other hand of the person holding the plate will be free to hold a utensil to eat the food on the plate. In a preferred embodiment, the serving plate is circular, and the depression in the center of the plate is frustoconical or cylindrical. On the lower surface of the plate, the depression has ridges by which it may be more effectively gripped. On the upper surface of the plate, there is an outer rim extending around the circumference of the plate, and an inner rim extending around the depression in the center of the plate, and a food holding area between the outer rim and the inner rim, that is at a lower level than the outer rim and the inner rim. There are dividers extending from the inner rim to the outer rim to divide the food holding area into a plurality of compartments. There are holes in the outer rim, for holding utensils or napkins. Corresponding upper surfaces and the lower surfaces nest so that a plurality of the plates may be easily stacked.

8 Claims, 3 Drawing Sheets

SOCIAL SERVING PLATE

BACKGROUND OF THE INVENTION

1. Field of the Invention

The present invention relates to a plate for food with a depression in its center, which serves both as a holder for a cup, and as a handle by which the plate can be held in one hand, leaving the other hand free to hold an utensil for eating the food.

2. Description of the Prior Art

At social gatherings where food and drink are served people tend to stand and move about while talking and eating at the same time. As a result, guests are often placed in an awkward position as they attempt to hold a plate in one hand and a cup in the other, leaving themselves with no free hand to pick up the food with a utensil to eat it. The present invention solves this problem, with a plate having a cylindrical depression in its center to hold a cup or glass, so that the other hand of the party goer is free. Whereas the combination of a plate and a cup holder is known, the prior art does not disclose a circular plate for holding food with a depression at its center shaped to hold a cup securely on an upper surface while the lower surface of the depression can be used as a handle to hold the plate in one hand.

U.S. Pat. No. 5,119,967, issued to David A. Ercolani, on Jun. 9, 1992, describes a one handed controllable plate and cup holder, with the cup holder placed outside the plate holder.

U.S. Pat. No. 5,285,940, issued to Victor H. Goulter, on Feb. 15, 1994, describes a folding neck-supported food tray, with a hook for holding the tray around the user's neck, and with a ring for holding a cup placed above the tray.

U.S. Pat. No. 5,301,871, issued to David F. Gross, Chris A. Mercede, and Brian S. Grant, on Apr. 12, 1994, describes a plate and cup holder formed from folding panels, with the cup holder alongside of the plate holder.

U.S. Pat. No. 5,353,952, issued to Mark L. Donche, on Oct. 11, 1994, describes an one-handed party and utility plate. The plate slopes downward toward the center, but has a level top surface that divides it into compartments for different kinds of food, with a circular recess in the center for a cup. The recess does not project through the bottom of the plate. A separate handle attached to the bottom of the plate is used to hold the plate by slipping an opened hand of a user between the plate and the handle. As such, the handle fails the user to maintain a firm grip on the plate.

U.S. Pat. No. Des. 332,552, issued to C. Richard Lynch, on Jan. 19, 1993, U.S. Pat. No. Des. 334,112, issued to Gary G. Carter, on Mar. 23, 1993, and U.S. Pat. No. Des. 349,212, issued to C. Richard Lynch, on Aug. 2, 1994, each disclose a combined cup and plate holder, with the cup holder alongside the plate holder.

British Patent No. 255,643, issued to Norman Louis Morrison, complete application accepted Jul. 29, 1926, describes a combined plate and saucer, with the saucer alongside the plate.

British Patent No. 266,528, issued to Cube Teapots Limited and Robert Crawford Johnson, complete application accepted Mar. 3, 1927, describes a device for holding a tea-cup and light refreshments, with the tea-cup retained in a recess on one side, and the refreshments retained in a recess on the opposite side.

Canadian Patent No. 508,205, issued to Arthur G. Goldberg, on Dec. 14, 1954, shows an automatic serving tray, erected by folding several panels together, and when properly folded has three spaces for retaining cups alongside a space for retaining food.

Canadian Patent No. 711,612, issued to Frederick A. Wenzel, on Jun. 15, 1965, describes a service tray, erected by folding several panels together, and when folded has four spaces for retaining cups, two each on opposite sides of a food retaining space.

French Patent No. 1,408,476, issued to Aktiebolaget Electrolux, published Jul. 5, 1965, describes a serving tray with spaces for cups on one side.

British Patent No. 1,204,633, issued to Peter Edward Stoneham and Patricia Kitty Stoneham, published Sep. 9, 1970, describes a flat pack which can be erected to form a tray having cup holders on opposites sides of a food compartment.

German Publication No. 24 26 361 by Keyes Fibre Co., published on Apr. 17, 1975, describes a tray having a pair of cup holders in the center, which do not have depressions projecting through the bottom of the plate so that they may be used to hold the plate.

British Patent No. 2 078 493, issued to Malcolm William Francis Quantrill, published on Jan. 13, 1982, describes a party plate or dish, with a keyhole-shaped slot for a wine-glass stem.

German Publication No. 27 53 762 by Heinrich Fichte, published on Jun. 7, 1979, describes a plate for serving portion-controlled packages resulting in trash materials, which provides a central raised structure for receiving a trash container, but which structure does not protrude beneath the plate.

None of the above inventions and patents, taken either singly or in combination, is seen to describe the instant invention as claimed.

SUMMARY OF THE INVENTION

Accordingly, it is a principal object of the invention to provide a plate for both food and a cup for drink, easily and firmly held in one hand, leaving the user's other hand free.

It is another object of the invention to combine a plate and cup holder in such a manner that the cup will not easily tip and spill its contents over food on the plate, by placing the cup in a deep recess that is centrally located.

It is a further object of the invention to combine a plate and cup holder shaped so that a plurality of the combined articles may be easily stacked in a relatively small space.

Still another object of the invention is to combine a plate and cup holder in such a manner that the combination may be economically produced in large quantities.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
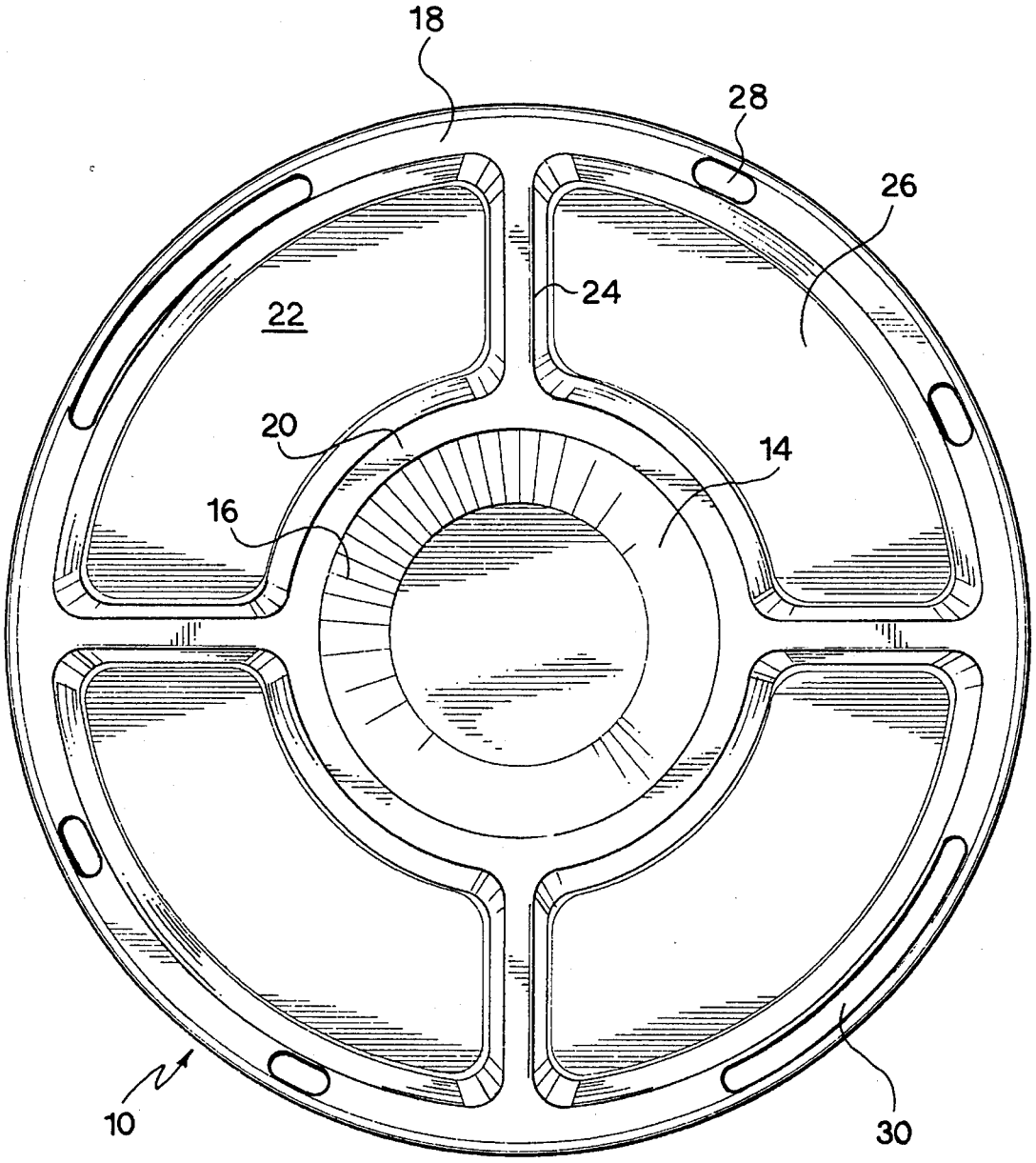
FIG. 1 is a top view of the invention.
Figure 2:
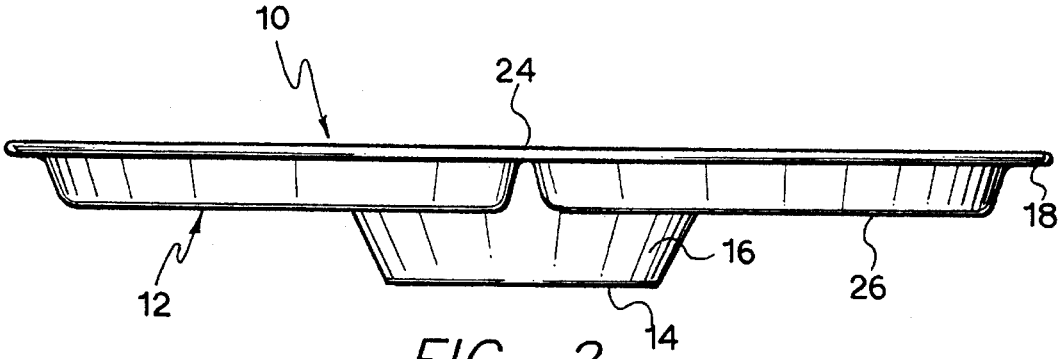
FIG. 2 is a side elevational view of the invention.
Figure 3:
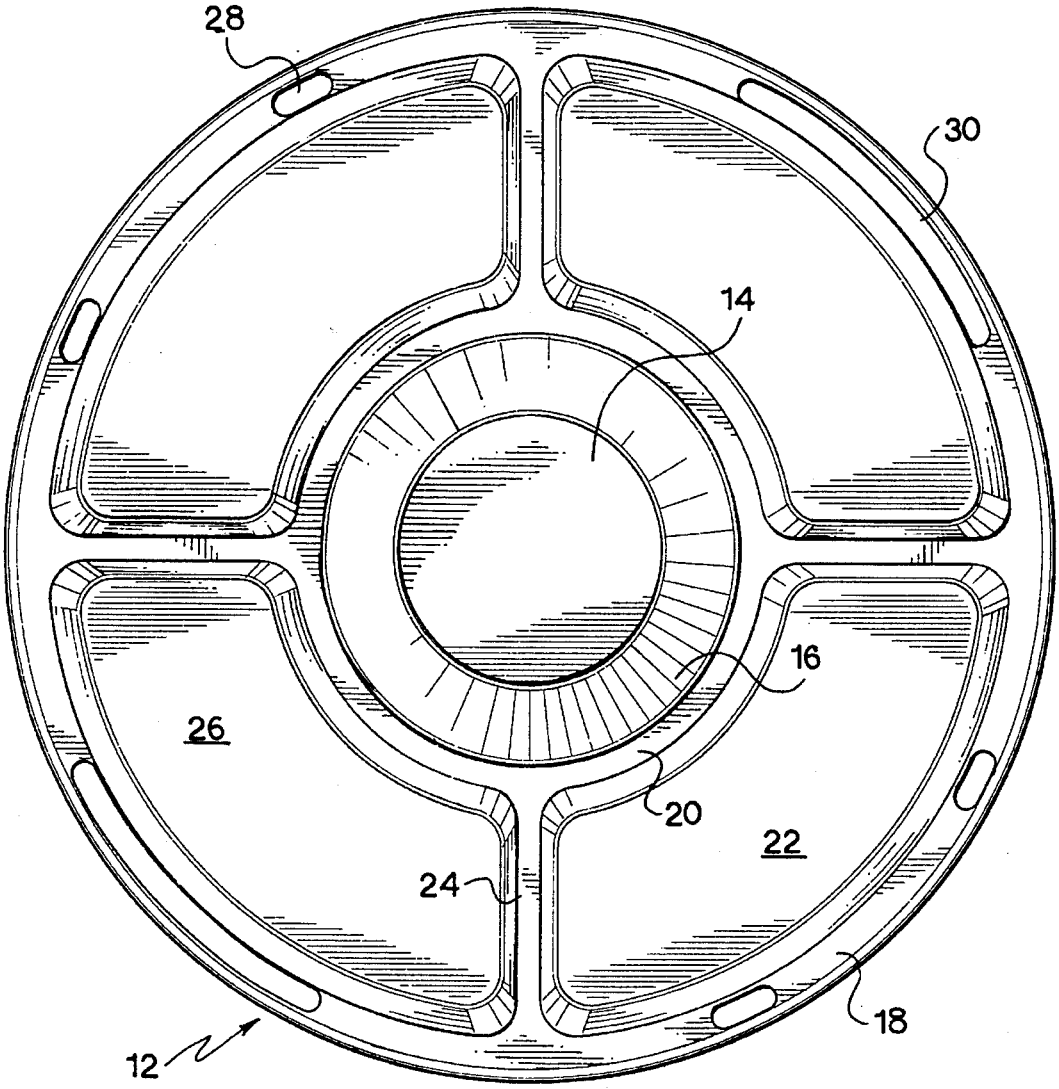
FIG. 3 is a bottom view of the invention.

The present invention is for a plate for holding food and a beverage container, having an upper surface 10 as shown in FIG. 1 and a lower surface 12 as shown in FIG. 3. A side elevational view of the plate is shown in FIG. 2. The plate defines a depression 14 in the center of the plate, suitably dimensioned and configured so that the upper surface of the plate is concave and capable of receiving a beverage container and the lower surface is convex and adapted to serve as a handle by which the plate can be held.

Figure 4:
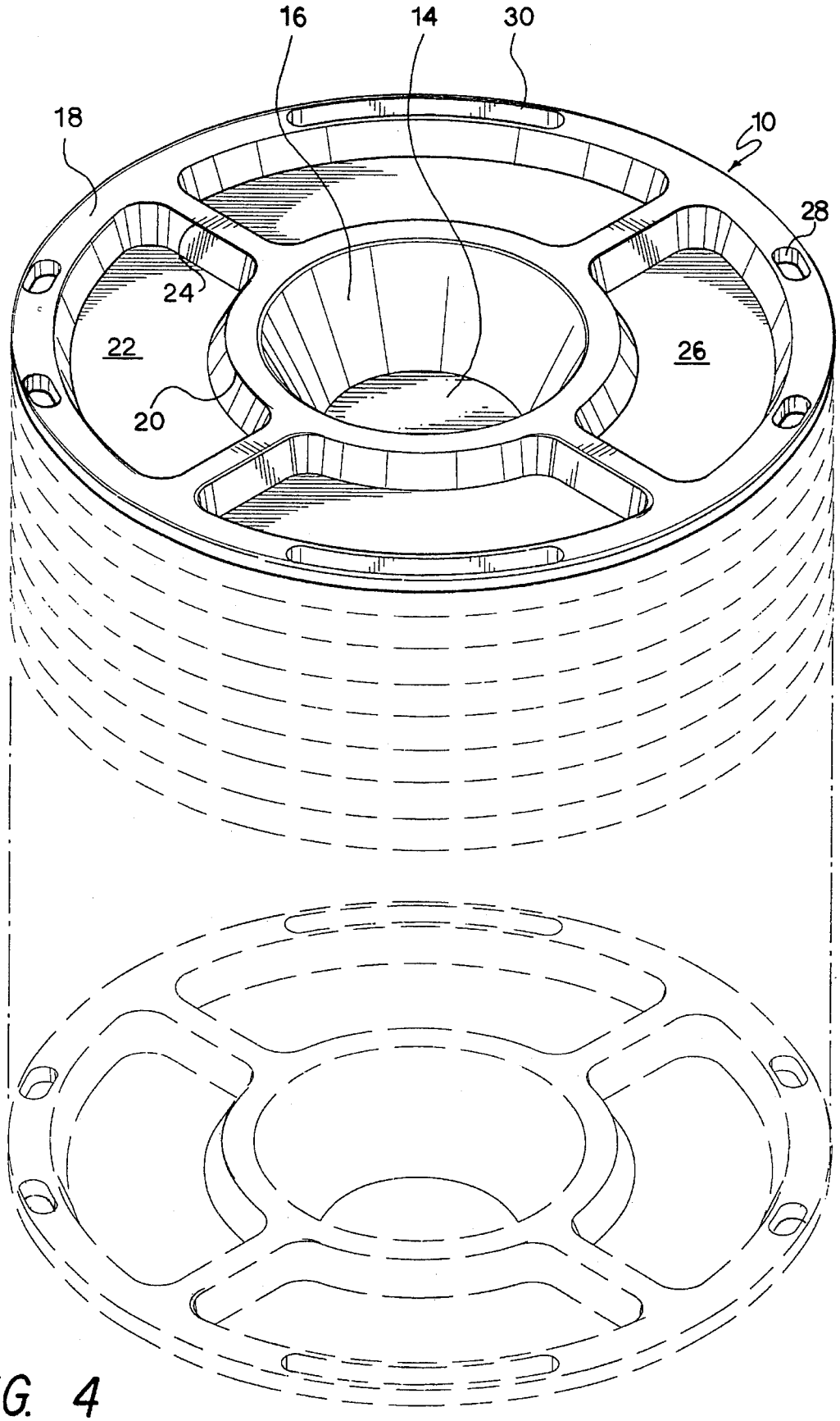
FIG. 4 is an exploded perspective view showing how a plurality of plates made according to the invention can be stacked together.

In the preferred embodiment, the serving plate is circular. Preferably, the depression in the center of the plate is frustoconical. Alternatively, the depression may be cylindrical (not shown in the drawings). On each surface of the plate, the depression in the center of the plate has ridges 16, which ridges on the lower surface allow the plate to be more effectively gripped. On the upper surface of the plate, there is an outer rim 18 extending around the perimeter of the plate, and an inner rim 20 extending around the depression 14 in the center of the plate, and a food holding area 22 between the outer rim and the inner rim, that is at a lower level than the outer rim and the inner rim. There are four dividers 24 extending from the inner rim to the outer rim, the dividers being at a higher level than the food holding area, and serving to divide the food holding area into compartments 26. The outer rim 18 defines holes 28 and 30 extending through the plate between the upper surface and the lower surface. Smaller holes 28 are designed to hold utensils, while larger holes 30 are intended to hold napkins. Corresponding features of the upper surface and the lower surface nest so that a plurality of the plates can be easily stacked, as shown in FIG. 4.

It is to be understood that the present invention is not limited to the sole embodiment described above, but encompasses any and all embodiments within the scope of the following claims.

I claim:

1. A serving plate comprising:

a circular plate having an upper surface, a lower surface, a depression in the center of said plate for holding a beverage container, said depression having ridges formed in said lower surface for facilitating manual holding of said plate, an outer rim around the perimeter of said plate including at least one small hole therethrough for holding an eating utensil, said outer rim further including at least one elongated hole for holding a napkin, and an inner rim around said depression, said inner rim and said outer rim defining a food holding area of said plate.

2. The serving plate according to claim 1, wherein said depression is frustoconical.

3. The serving plate according to claim 1, wherein said depression is cylindrical.

4. The serving plate according to claim 1, wherein there are a plurality of dividers extending from the inner rim to the outer rim, said dividers being at a higher level than the food holding area, and serving to divide the food holding area into a plurality of compartments.

5. The serving plate according to claim 1, wherein, for all portions of the plate, the upper surface and the lower surface are parallel.

6. The serving plate according to claim 5, wherein the depression in the center of the plate is frustoconical.

7. The serving plate according to claim 5, wherein the depression in the center of the plate is cylindrical.

8. The serving plate according to claim 5, wherein there are a plurality of dividers extending from the inner rim to the outer rim, said dividers being at a higher level than the food holding area, and serving to divide the food holding area into a plurality of compartments.

* * * * *